US011519058B2

(12) United States Patent
Da Fonseca Barbatti et al.

(10) Patent No.: US 11,519,058 B2
(45) Date of Patent: Dec. 6, 2022

(54) 6XXX ALUMINIUM ALLOY EXTRUDED FORGING STOCK AND METHOD OF MANUFACTURING THEREOF

(71) Applicant: CONSTELLIUM EXTRUSIONS DECIN S.R.O., Decin V (CZ)

(72) Inventors: Carla Da Fonseca Barbatti, Fontaine (FR); Ivo Kolarik, Decin (CZ); Matus Bajcura, Decin (CZ)

(73) Assignee: CONSTELLIUM EXTRUSIONS DECIN S.R.O., Decin V (CZ)

( * ) Notice: Subject to any disclaimer, the term of this patent is extended or adjusted under 35 U.S.C. 154(b) by 0 days.

(21) Appl. No.: 16/955,317

(22) PCT Filed: Dec. 20, 2018

(86) PCT No.: PCT/EP2018/086091
§ 371 (c)(1),
(2) Date: Jun. 18, 2020

(87) PCT Pub. No.: WO2019/122076
PCT Pub. Date: Jun. 27, 2019

(65) Prior Publication Data

US 2021/0017631 A1 Jan. 21, 2021

(30) Foreign Application Priority Data

Dec. 21, 2017 (EP) ..... 17209856

(51) Int. Cl.
*B21J 5/02* (2006.01)
*C22C 21/02* (2006.01)
(Continued)

(52) U.S. Cl.
CPC ..... *C22C 21/02* (2013.01); *B21J 5/02* (2013.01); *C22C 21/04* (2013.01); *C22C 21/08* (2013.01);
(Continued)

(58) Field of Classification Search
None
See application file for complete search history.

(56) References Cited

U.S. PATENT DOCUMENTS 6,302,973 B1 * 10/2001 Haszler ..... B32B 15/016 148/437
6,678,574 B2 1/2004 Fujii et al.
(Continued)

FOREIGN PATENT DOCUMENTS

CN 1071970 A 5/1993
CN 103361520 A 10/2013
(Continued)

OTHER PUBLICATIONS

V. Raghavan, "Al—Fe—Mg—Mn—Si (Aluminum-Iron-Magnesium-Manganese-Silicon)," Journal of Phase Equilibria and Diffusion, (2007), vol. 28, No. 2: 221-222.
(Continued)

*Primary Examiner* — Daniel J. Schleis
(74) *Attorney, Agent, or Firm* — McBee Moore & Vanik IP, LLC; Susan McBee; David Vanik

(57) ABSTRACT

The invention concerns an aluminum extruded product as feedstock for forging comprising in weight percent Si: 0.6% to 1.4%, Fe: 0.01% to 0.15%, Cu: 0.05% to 0.60%, Mn: 0.4% to 1%, Mg: 0.4% to 1.2%, Cr: 0.05% to 0.25%, Zn≤0.2%, Ti≤0.1%, Zr≤0.05%, the rest being aluminium and unavoidable impurities having a content of less than 0.05% each, total being less than 0.15%, wherein the number density of Mn containing dispersed particles is at least equal to 2.5 particles per $\mu m^2$, preferably 3.0 particles per μm.

The invention also concerns the process to obtain the aluminum extruded product as feedstock for forging.

19 Claims, 1 Drawing Sheet

G

(51) Int. Cl.

| | |
|---|---|
| ***C22C 21/04*** | (2006.01) |
| ***C22C 21/08*** | (2006.01) |
| ***C22F 1/043*** | (2006.01) |
| ***C22F 1/047*** | (2006.01) |
| ***C22F 1/05*** | (2006.01) |

(52) U.S. Cl.
CPC ..... *C22F 1/043* (2013.01); *C22F 1/047* (2013.01); *C22F 1/05* (2013.01)

(56) References Cited

U.S. PATENT DOCUMENTS

| | | | | |
|---|---|---|---|---|
| 2014/0290809 | A1* | 10/2014 | Hori ..... | C22C 21/08 148/550 |
| 2017/0314113 | A1 | 11/2017 | Skubich et al. | |

FOREIGN PATENT DOCUMENTS

| | | | |
|---|---|---|---|
| CN | 104073689 | A | 10/2014 |
| EP | 2003219 | A2 | 12/2008 |
| EP | 2644725 | A2 | 10/2013 |
| EP | 2644727 | A2 | 10/2013 |
| EP | 3018226 | A1 | 5/2016 |
| EP | 3124633 | A1 | 2/2017 |
| JP | 2000345364 | A | 12/2000 |
| RU | 2163939 | C1 | 3/2001 |
| WO | 2014014795 | A1 | 1/2014 |
| WO | 2017207603 | A1 | 12/2017 |

OTHER PUBLICATIONS

Chinese Search Report for Application No. 2018800826662 dated Mar. 30, 2021.
PCT International Search Report for PCT/EP2018/086091, dated Apr. 4, 2019.

* cited by examiner

G

F

E

6XXX ALUMINIUM ALLOY EXTRUDED FORGING STOCK AND METHOD OF MANUFACTURING THEREOF

CROSS-REFERENCE TO RELATED APPLICATIONS

This application is the National Stage entry of International Application No. PCT/EP2018/086091, filed 20 Dec. 2018, which claims priority to European Patent Application No. 17209856.8, filed 21 Dec. 2017.

FIELD OF THE INVENTION

The present invention relates to a 6xxx aluminium alloy extruded forging feedstock material permitting to forge thin structural materials with a good balance between strength, ductility and fatigue properties. The invention also relates to forged products for automotive applications for which extruded bars are used as feedstock material. The invention also relates to a method of manufacturing such 6xxx aluminium extruded forging feedstock.

DESCRIPTION OF RELATED ART

Demand for vehicle weight reduction continues to increase to integrate more safety components while decreasing $CO_2$ emissions. Auto-manufacturers are then looking for structural materials with the best balance between strength, ductility and weight. In particular, suspension arms are components of high stake to answer to this demand.

Aluminum forgings are often applied because of their low density and substantive strength. Aluminum forgings are particularly interesting for suspension arms, in particular 6xxx series (Al—Mg—Si) forgings. Usually, the structure of a suspension is called a "double-wishbone". It consists of several parts including a lower arm, upper arm and knuckle. Because these parts constitute an unsprung mass, decreasing their weights contributes not only to the overall weight reduction, but also to stable driving performance and high riding quality. There is consequently a strong demand for obtaining thinner sections of forged materials while insuring high strength and ductility.

Aluminum forgings are usually obtained by the following route: First, aluminum alloy is formed into a round bar by extrusion or casting and the round bar is cut into lengths. The obtained forging stock undergoes pre-forming so that it has a volume distribution resembling the finished product. Then, the preformed forging stock undergoes forging in multiple stages as described for example in U.S. Pat. No. 6,678,574. The obtained aluminum forged product is possibly solution heat treated, quenched, and aged to obtain the final mechanical properties.

However, due to the several deformation steps typically at high temperature, recrystallization may occur during the forgings steps and/or during the final heat treatment. This can be detrimental to final mechanical properties.

Recrystallization needs to be controlled to obtain thin structural materials with balanced strength, ductility and fatigue and further lighten the weights of automobiles. Therefore, there have been various attempts to improve the microstructure of Al alloy cast materials and Al alloy forging materials.

WO2017/207603 discloses a hot rolled semi-finished 6xxx series aluminium alloy forging stock material having a thickness in the range of 2 mm to 30 mm, and having a composition comprising of in wt % Si 0.65-1.4%, Mg 0.60-0.95%, Mn 0.40-0.80%, Cu 0.04-0.28%, Fe up to 0.5%, Cr up to 0.18%, Zr up to 0.20%, Ti up to 0.15%, Zn up to 0.25%, impurities each <0.05%, total <0.2%, balance aluminium, and wherein it has a substantially unrecrystallized microstructure.

EP 2003219 discloses an aluminum alloy forging material with the following composition (in weight %) 0.5 to 1.25% of Mg, 0.4 to 1.4% of Si, 0.01 to 0.7% of Cu, 0.05 to 0.4% of Fe, 0.001 to 1.0% of Mn, 0.01 to 0.35% of Cr, 0.005 to 0.1% of Ti, Zr controlled to less than 0.15%, and the balance composed of Al and inevitable impurities and with a density of Al—Fe—Si crystals observed in the sectional structure of the maximum stress producing site presenting an average area ratio of 1.5% or less, and an average spacing between grain boundary particles? composed of $Mg_2Si$ and elemental Si precipitates of 0.7 mm or more in the sectional structure including a parting line, which is produced in forging.

EP 2003219 discloses a manufacturing method of a forged material obtained directly from the cast ingot.

EP 2644725 discloses an aluminium alloy forged material comprising (in wt. %) 0.7% to 1.5% of Si, 0.1% to 0.5% of Fe, 0.6% to 1.2% of Mg, 0.01% to 0.1% of Ti, 0.3 to 1.0% of Mn, comprising at least one element selected from Cr 0.1-0.4% and Zr 0.01 to 0.2%, restricting Cu 0.1% or less and Zn 0.05% or less and a hydrogen amount of 0.25 ml/100 g of Al or less, the remainder being Al and unavoidable impurities, wherein the depth of recrystallization from the surface is 5 mm or less. EP 2644725 does not give any insights of using a low extrusion ratio and presents examples using cast feedstock for forging.

EP 3018226 discloses an aluminium alloy forged product obtained by casting a billet from a 6xxx aluminium alloy comprising: Si: 0.7-1.3 wt. %; Fe: ≤0.5 wt. %; Cu: 0.1-1.5 wt. %; Mn: 0.4-1.0 wt. %; Mg: 0.6-1.2 wt. %; Cr: 0.05-0.25 wt. %; Zr: 0.05-0.2 wt. %; Zn: ≤0.2 wt. %; Ti: ≤0.2 wt. %, the rest being aluminium and inevitable impurities; homogenising the cast billet, at a temperature TH, which is 5° C. to 80° C. lower than solidus temperature Ts, in the range of typically 500-560° C., for a duration between 2 and 10 hours; quenching said billet down to room temperature by using water quench system; heating the homogenised billet to a temperature between (Ts−5° C.) and (Ts−125° C.); extruding said billet through a die to produce a solid section with an exit temperature (typically 530° C.) lower than Ts (typically 550° C.), and with an extruding ratio of at least 8; quenching the extruded product down to room temperature by using water quench system; stretching the extruded product to obtain a plastic deformation typically between 0.5% and 10%; heating cut-to-length extruded rod to forging temperature, typically between 400 and 520° C.; forging in heated mould between 150 and 350° C.; separate solutionising at a temperature between 530 and 560° C. for durations between 2 min. and 1 hour; water quenching the forged and solutionised material down to room temperature; room temperature ageing for a duration between 6 hours and 30 days; ageing to T6 temper by a one- or multiple-step heat treatment at temperatures ranging from 150 to 200° C. for holding times ranging from 2 to 20 hours.

EP 2644727 discloses an aluminium forged material for automotive vehicles using extruded feedstock. The aluminium alloy forged material is obtained according the following method with the following order of;

a melting and casting process of melting the aluminum alloy comprising: 0.6 to 1.2 mass % of Mg; 0.7 to 1.5 mass % of Si; 0.1 to 0.5 mass % of Fe; 0.01 to 0.1 mass % of Ti; 0.3~1.0 mass % of Mn; at least one of 0.1~0.4 mass % of Cr and 0.05~0.2 mass % of Zr; a restricted amount of Cu that is less than or equal to 0.1 mass %, a restricted amount of Zn that is less than or equal to 0.05 mass %, a restricted amount of H that is less than or equal to 0.25 ml in 100 g Al and a remainder of Al and inevitably contained impurities, to a melting temperature between 700° C. and 780° C. and casting the melt aluminum alloy to an ingot;

a homogenizing heat treatment process of heating the ingot at a temperature rising speed that is equal to or higher than 1.0° C./minute, keeping the ingot between 470° C. and 560° C. for 3-12 hours and cooling the ingot to a temperature lower than or equal to 300° C. at a temperature lowering rate equal to or higher than 2.5° C./minute;

a first heating process of heating the ingot between 500° C. and 560° C. for more than 0.75 hours;

an extruding process of extruding the ingot at an extrusion speed of 1-15 m/minute and at an extrusion ratio between 15 and 25 to an extruded material while a temperature of the ingot is between 450° C. and 540° C.;

a second heating process of heating the extruded material between 500° C. and 560° C. for more than 0.75 hours;

a forging process of forging the extruded material that is heated to a forging start temperature between 450° C. and 560° C. to a forged material in a desired shape at a forging end temperature higher than or equal to 400° C.;

a solution treatment process of performing a solution treatment of heating the forged material at a solution treatment temperature between 500° C. and 560° C. for 38 hours;

a quenching process of quenching the forged material at a quenching temperature lower than or equal to 60° C., and an artificial ageing treatment process of keeping the forged material at an ageing temperature between 160° C. and 220° C. for 3-12 hours.

The chemical composition proposes to have a Fe amount between 0.1 to 0.5% with a preferred range of 0.2 to 0.3% and an extrusion ration between 15 to 25, assuming that below 15, the extruded material does not have a sufficiently fiber-like metal structure in which precipitated crystalline particles are made finer and modified and recrystallization easily occurs in this extruded material, which results in the tensile strength of the extruded material being not significantly increased.

SUMMARY OF THE INVENTION

Unless otherwise stated, all information concerning the chemical composition of the alloys is expressed as a percentage by weight based on the total weight of the alloy. "6xxx aluminium alloy" or "6xxx alloy" designate an aluminium alloy having magnesium and silicon as major alloying elements. "AA6xxx-series aluminium alloy" designates any 6xxx aluminium alloy listed in "International Alloy Designations and Chemical Composition Limits for Wrought Aluminum and Wrought Aluminum Alloys" published by The Aluminum Association, Inc. Unless otherwise stated, the definitions of metallurgical tempers listed in the European standard EN 515—October 1993 will apply.

Static tensile mechanical characteristics, in other words, the ultimate tensile strength Rm (or UTS), the tensile yield strength at 0.2% plastic elongation Rp0,2 (or YTS), and elongation A % (or E %), are determined by a tensile test according to NF EN ISO 6892-1 of July 2014.

The aim of the invention is to achieve the required optimized balance between strength, ductility and fatigue on forged products for which extruded products are used as feedstock. It can be done by controlling the recrystallization during forging or during subsequent thermal treatments. Controlling the recrystallization permits to maintain the fibrous structure of the extruded feedstock and to limit recrystallization or the appearance of peripheral coarse grains ("PCG") in the surface layer.

The inventors have found that it is possible to control the recrystallization during forging by using an aluminium extrusion feedstock with the following composition in weight %

Si: 0.6% to 1.4%,
Fe: 0.01% to 0.15%,
Cu: 0.05% to 0.60%,
Mn: 0.4% to 1%,
Mg 0.4% to 1.2%,
Cr: 0.05% to 0.25%,
Zn≤0.2%,
Ti≤0.1%,
Zr≤0.05%,
the rest being aluminium and unavoidable impurities having a content of less than 0.05% each, total being less than 0.15%.

DETAILED DESCRIPTION OF A PREFERRED EMBODIMENT

Figure 1:
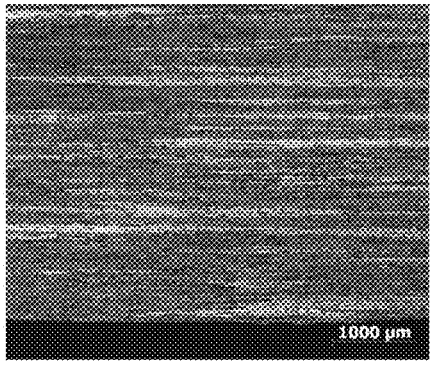
FIG. 1 to FIG. 3 represents cross sections of samples representing the fibrous aspect vs. extrusion ratio, exemplified in example 2.
Figure 2:
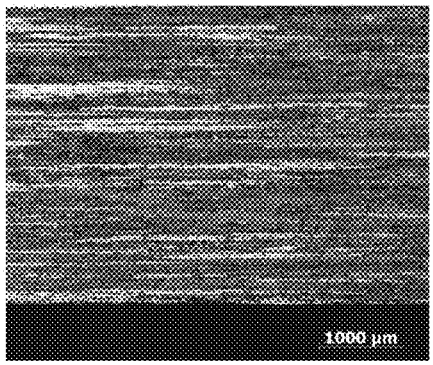
Figure 3:
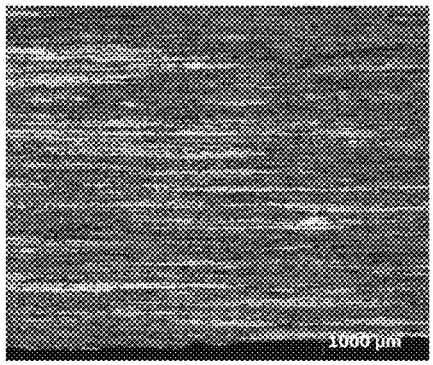

The alloying composition and the corresponding microstructure of the aluminium extrusion feedstock for forging allows the subsequent production of forged products with the good balance between strength, ductility and fatigue. It has been found that it can be achieved by using an extruded feedstock with a Fe content up to 0.15 wt. %, preferably up to 0.13 wt. % and even more preferably up to 0.12 wt. % or up to 0.10 wt. %. Maintaining a Fe content equal or lower than 0.15 wt. % permits to limit the recrystallization during forging or during subsequent thermal heating. The inventors found in particular that a good balance between strength, ductility and fatigue on forged products can be obtained in correlation with the composition if number density of Mn containing dispersed particles is equal or more than 2.5 particles per $\mu m^2$, preferably more than 3.0 Mn containing dispersed particles per $\mu m^2$.

Small Mn containing dispersed particles are preferred to limit recrystallization. The average diameter of Mn containing dispersed particles is preferably less than 80 nm, more preferably less than 60 nm and even more preferably less than 50 nm. The inventors also found that recrystallization is ensured with a surface fraction of Mn containing dispersed particles between 0.3% and 3%, and more preferably between 0.3% and 1.5% and even more preferably between 0.3% and 0.7%.

In a preferred embodiment, the maximum fraction of texture components belonging to the <001> fiber is 20%. It permits to reduce the propensity of the forged products to develop texture components typical of recrystallization.

In a preferred embodiment, the invention is particularly interesting for a composition comprising in wt. %

Si: 1.2% to 1.3%

Fe: 0.01 to 0.15%, preferably between 0.01% to 0.13%
Cu: 0.05% to 0.15%
Mn: 0.7% to 0.8%, preferably between 0.75% to 0.80%.
Mg: 0.8% to 0.9%, preferably between 0.80% to 0.90%.
Cr: 0.10% to 0.25%
Zn≤0.2%
Ti≤0.1%
Zr≤0.05%
the rest being aluminium and unavoidable impurities having a content of less than 0.05% each, total being less than 0.15%.

In another preferred embodiment, the invention is particularly interesting for a composition comprising in wt. %
Si: 0.8% to 1%
Fe: 0.01 to 0.15%, preferably between 0.01% to 0.13%
Cu: 0.40% to 0.55%
Mn: 0.4% to 0.6%
Mg: 0.7% to 0.9%, preferably between 0.70% to 0.85%.
Cr: 0.10% to 0.25%
Zn≤0.2%
Ti≤0.1%
Zr≤0.05%
the rest being aluminium and unavoidable impurities having a content of less than 0.05% each, total being less than 0.15%.

Another aim of the invention is a process for manufacturing aluminium extrusion feedstock permitting to achieve the balance between strength, ductility and fatigue for specific forged products geometries presenting areas formed through a high reduction ratio. The process is particularly interesting to produce H shaped sectional forms, with central web thickness less than 8 mm, preferably less than 7 mm and even more preferably less than 6 mm.

The process comprises the following steps a. Casting a billet of aluminum alloy comprising in weight percent
Si: 0.6% to 1.4%
Fe: 0.01% to 0.15%, preferably between 0.01% to 0.13%, more preferably between 0.01% to 0.12% and even more preferably between 0.01% to 0.10%
Cu: 0.05% to 0.60%
Mn: 0.4% to 1%
Mg 0.4% to 1.2%
Cr: 0.05%-0.25%
Zn≤0.2%
Ti≤0.1%
Zr≤0.05%
the rest being aluminium and unavoidable impurities having a content of less than 0.05% each, total being less than 0.15%,
b. Homogenizing said billet between 480 to 560° C. during 2 to 12 hours and preferably between 490° C. and 510° C. during 2 to 12 hours
c. Extruding said homogenized billet as a solid extrusion, with an extrusion ratio less than 15. Preferably the extrusion ratio is less than 13. Preferably the solid extrusion has a round bar shape.

The extrusion ratio is defined by the ratio between the section of the press container and the section of the extrusion. Low extrusion ratio in combination with the chemical composition with low Fe content and homogenizing conditions, between 480° C. to 560° C. during 2 to 12 hours, preferably at 500° C.+/−10° C. during 2 to 12 hours permits to limit recrystallization during forging to obtain satisfying balance between strength, ductility and fatigue for specific forged products.

Preferably the composition of step a) comprises in wt. %
Si: 1.2% to 1.3 wt. %
Fe: 0.01 to 0.15%, preferably between 0.01% to 0.13%
Cu: 0.05% to 0.15%
Mn: 0.7% to 0.8%, preferably between 0.75% to 0.80%.
Mg: 0.8% to 0.9%, preferably between 0.80% to 0.90%.
Cr: 0.10% to 0.25%
Zn≤0.2%
Ti≤0.1%
Zr≤0.05%
the rest being aluminium and unavoidable impurities having a content of less than 0.05% each, total being less than 0.15%

In another embodiment, the composition of step a) comprises in wt. %
Si: 0.8% to 1 wt. %
Fe: 0.01 to 0.15%, preferably between 0.01% to 0.13%
Cu: 0.40% to 0.55%
Mn: 0.4% to 0.6%
Mg: 0.7% to 0.9%, preferably between 0.70% to 0.85%.
Cr: 0.10% to 0.25%
Zn≤0.2%
Ti≤0.1%
Zr≤0.05%
the rest being aluminium and unavoidable impurities having a content of less than 0.05% each, total being less than 0.15%.

The extrusion feedstock according to the invention is advantageously used for obtaining a forged product. In a preferred embodiment, the operations after extrusion consists of two pass rolling, bending and finally forging with intermediate heat treatments between deformation steps at a temperature above 500° C. The forged product is either produced in T5 temper and then artificially aged or produced in T6 temper with a separate solution heat treatment and artificially aged after final forging steps.

Low extrusion ratio, less than 15, preferably less than 13 in combination with the chemical composition with low Fe content according to the invention and homogenizing conditions between 480° C. to 560° C., preferably between 490° C. to 510° C. during 2 to 12 hours permits to limit the recrystallization fraction to less than 50%, preferably 48% in the forged product. If the forged product is produced in T5 temper, i.e. not submitted to a separate solution heat treatment, the recrystallization fraction is less than 15% in the forged product.

The recrystallization fraction is measured in the part of the forged product with the highest reduction rate during forging. The recrystallization fraction is measured in the thinnest part of the forged product. This location is particularly of interest because, due to the highest reduction rate and consequently the accumulated strain during rolling and subsequent forging processes, it is more prone to recrystallization.

In a particular embodiment, the forged product has a H shape as described in EP 2003219 at FIG. 1*b*) or in EP 2644725 at FIG. 7 and includes a thin central web and ribs at the two extremities. An H type forged product obtained from an aluminium extrusion feedstock obtained according to the invention presents a recrystallization fraction less than 50% in the central web. Preferably the central web presents a thickness lower than 8 mm, preferably lower than 6 mm.

An H type forged product obtained from an aluminium extrusion feedstock obtained according to the invention and which is produced in T5 temper, i.e. obtained with no separate solution heat treatment presents a recrystallization fraction less than 15% in the central web. Preferably the central web presents a thickness lower than 8 mm, preferably lower than 6 mm.

The inventors found that it is particularly interesting to use for forging an aluminium extruded feedstock with the following composition in weight % Si: 1.2% to 1.3% of Si, 0.01 to 0.15%, preferably between 0.01% to 0.13% of Fe, 0.05% to 0.15% of Cu, 0.7% to 0.8%, preferably between 0.75% to 0.80% of Mn, 0.8% to 0.9%, preferably between 0.80% to 0.90% of Mg, 0.10% to 0.25% of Cr, less than 0.2% of Zn, less than 0.1% of Ti, less than 0.05% of Zr, the rest being aluminium and unavoidable impurities having a content of less than 0.05% each, total being less than 0.15%, for obtaining a forged product. It permits an advantageous balance between ductility and strength with a yield strength higher than 350 MPa and an elongation higher than 13% on the forged product. Mechanical properties are measured in the part of the forged product with the highest reduction rate during forging. The mechanical properties are measured in the thinnest part of the forged product. This location is particularly of interest because, due to the highest reduction rate and consequently the accumulated strain during rolling and subsequent forging processes, it is more prone to recrystallization. Due to this recrystallization, it is expected that it corresponds to the weakest point of the forged product. Typically, H shaped sectional forms are forged, as described in EP 2003219 at FIG. 1*b*) or in EP 2644725 at FIG. 7 and includes a thin central web and ribs at the two extremities. Central web in this case is the part with the most strained area. Mechanical properties are then measured in the central web for H shaped sectional forms. EP2003219 characterized the mechanical properties in the rib, where presumably the mechanical properties are the highest due to a lesser extent of recrystallization.

DETAILED DESCRIPTION OF THE INVENTION

The inventors have found that it is possible to control the recrystallization during forging by using an aluminium extrusion feedstock with the following composition in weight %

Si: 0.6% to 1.4%
Fe: 0.01% to 0.15%
Cu: 0.05% to 0.60%
Mn: 0.4% to 1%
Mg: 0.4% to 1.2%
Cr: 0.05% to 0.25%
Zn≤0.2%
Ti≤0.1%
Zr≤0.05%
the rest being aluminium and unavoidable impurities having a content of less than 0.05% each, total being less than 0.15%.

Si and Mg content are defined so as to ensure high level of dissolved $Mg_2Si$ while minimizing presence of undissolved $Mg_2Si$ in the forged component after ultimate solutionising step, with a minimum content of 0.6 wt. % of undissolved $Mg_2Si$.

Si is combined with Mg to form $Mg_2Si$. The precipitation of $Mg_2Si$ contributes to increasing the strength of the final aluminium alloy forged product.

If the Si content is less than 0.6 wt. %, the final product does not have a sufficiently high strength.

On the other hand, if the Si content is more than 1.4 wt. %, the level of undissolved $Mg_2Si$ is too high and extrudability is reduced as well as corrosion resistance and toughness of the resultant final forged product.

Si is comprised between 0.6 wt. % and 1.4 wt. %. In a preferred embodiment, Si content is between 1.2% and 1.4% to obtain higher strength. In another embodiment, Si content is between 0.8 wt. % and 1.0 wt. % to obtain a good balance between strength and fatigue. Mg is combined with Si to form $Mg_2Si$. Therefore, Mg is needed for strengthening the product of the present invention. If the Mg content is lower than 0.4 wt. %, the effect is too weak. On the other hand, if the Mg content is higher than 1.2 wt. %, the billet becomes difficult to extrude and the extruded bar also is difficult to forge. Moreover, a large amount of $Mg_2Si$ particles tends to precipitate during quenching process after the solution heat treatment.

Mg content is between 0.4 wt. % and 1.2 wt. %, preferably between 0.7 wt. % and 0.9 wt. %. In one embodiment, Mg content is between 0.70 wt. % and 0.85 wt. %. In another embodiment, Mg content is between 0.8 wt. % and 0.9 wt. %, and more preferably between 0.80 wt. % and 0.90 wt. %.

Preferably, the ratio Mg/Si is between 0.5 to 1.2, preferably between 0.5 to 0.8.

Mn and Cr produce dispersed particles, which are formed during homogenization.

Dispersed particles with a sufficient number density per unit area prevent recrystallization during forging. Mn containing dispersed particles are preferred to prevent recrystallization due to a more homogeneous distribution within grains. Cr dispersed particles are complementary to Mn containing dispersed particles to enhance recrystallization resistance, but they present a more localized particle distribution due to Cr behavior during solidification reactions.

However, if the Mn content is less than 0.4 wt. %, the effect is not sufficient. On the other hand, if the content of Mn is higher than 1.0 wt. %, coarse precipitated particles are formed and both the workability and the toughness of the aluminium alloy are reduced. Coarse precipitated particles are also detrimental to preventing recrystallization. The Mn content is preferably between 0.4 wt. % and 0.8 wt. % and more preferably between 0.7 wt. % and 0.8 wt. %. In a preferred embodiment, Mn is in the range of 0.4% to 0.6% and in another embodiment, Mn is in the range of 0.7% to 0.8%.

If the Cr is less than 0.05 wt. %, preferably less than 0.10 wt. % the effect is not sufficient. If the content of Cr is higher than 0.25 wt. % coarse precipitated particles are formed and both the workability and the toughness of the aluminium alloy are reduced. Coarse precipitated particles are also detrimental to preventing recrystallization.

Fe combines with other elements, such as Mn and Cr, and may form dispersed particles and iron containing intermetallic particles.

Iron containing intermetallic particles are formed during casting and differ from Mn containing dispersed particles by higher dimension and stoichiometric chemical compositions.

The amount and the size of iron containing intermetallic particles should be restricted to enhance fatigue properties. It can be achieved by reducing Fe content. However, Fe is also known to be beneficial for grain structure control by preventing grain boundary migration after recrystallization, preventing coarsening of crystal grains and refining the grains, and a minimum content of about 0.15 wt. % is common. To the contrary, the inventors found that unexpectedly if the Fe content is kept in the range of 0.01 wt. % to 0.15 wt. %, preferably between 0.01 wt. % to 0.13 wt. %, more preferably between 0.01 wt. % to 0.12 wt. %, and even more preferably between 0.01 wt. % to 0.10 wt. % or between 0.01 wt. % to 0.08 wt. %, recrystallization can be prevented without adverse effects on the grain structure.

The present inventors found that when the Fe content is too high a detrimental effect for the formation of Mn containing dispersed particles is observed.

Although they are not bound to any theory, the inventors believe that low Fe content ensures a sufficient concentration of free Mn to permit the formation of Mn containing dispersed particles.

Fe content is interesting to be kept at a minimum of 0.01 wt %, preferably 0.02 wt. % and more preferably 0.05 wt %.

Cu content is between 0.05 wt. % to 0.60 wt. %. Cu strengthens the forged product. When the Cu content is too low, this effect cannot be obtained. On the other hand, if the Cu content is too high the alloy becomes sensitive to intergranular corrosion. Also, if the Cu content is too high, the extrudability is reduced. Preferably, Cu content is in the range of 0.05 wt. % to 0.55 wt. %, preferably between 0.15 wt. % to 0.55 wt. % and even more preferably between 0.40 to 0.55 wt. %. In a preferred embodiment, Cu is in the range of 0.05% to 0.15% and in another embodiment Cu is in the range of 0.40% to 0.55%.

Ti content is below 0.1 wt. %. Ti is a grain refiner to improve the resistance to hot cracking in the alloy and workability of the extruded product. Preferably, Ti content is at least 0.01 wt. %. When Ti exceeds 0.1 wt. %, the workability is deteriorated due to coarse precipitates.

Zr content is kept below 0.05 wt %. If the content of Zr is too high, the extrudability of the product is reduced. In addition, a too high Zr content can be detrimental to ductility and fatigue by the formation of primary crystals.

Zn content is equal or less to 0.2%. Zn can precipitate with Mg to form $MgZn_2$ during artificial aging treatment. It permits to increase the strength of the forged product. If Zn is too high, it can induce corrosion sensitivity.

In the present invention, Mn containing dispersed particles, also called Mn containing dispersoids particles are dispersed particles formed during homogenization. Mn containing dispersed particles are combination of Al, Mn, Fe, Si, Cr elements, such as Al—Mn, Al—Mn—Fe, Al—Cr—Mn or Al—Mn—Fe—Si composed dispersed particles. For instance, $Al_{15}(Mn,Fe)_3Si_2$ or $Ali_2CrMn$ can be present in the extruded feedstock.

Mn containing dispersed particles are formed at high temperature, typically higher than 480° C. They are preferably formed during the homogenizing treatment. Preferably, the homogenizing treatment is performed at a temperature between 480 to 560° C. during 2 to 12 hours. More preferably, the homogenizing treatment is performed at a temperature between 490° C. to 510° C., i.e 500° C.+/−10° C. during 2 to 12 hours. It is advantageous that before forging a sufficient number density of Mn containing dispersed particles are present in the extruded feedstock. Depending on forging conditions, the number density of Mn containing dispersed particles can be unchanged or increase or decrease depending on dissolution/re-precipitation/precipitation phenomena.

Dispersed particles affect the recrystallization behavior. When dispersed particles are fine and at a high density, they can obstruct the grain boundary movement during recrystallization and prevent coarsening of the crystal grain. This is also known as the Zener drag effect. The density or number density of Mn containing dispersed particles per unit area affects the susceptibility of the forged product for recrystallization. When the number density of Mn containing dispersed particles is higher than 2.5 per $\mu m^2$, recrystallization is decreased. This effect is more pronounced if the number density of Mn containing dispersed particles is higher than 3.0 per $\mu m^2$.

When the average diameter of Mn containing dispersed particles is lower than 80 nm, preferably lower than 60 nm and even more preferably lower than 50 nm, recrystallization is reduced.

Re-precipitation or dissolution of Mn containing dispersed particles are unwanted during forging and subsequent thermal treatment to maintain a homogeneous distribution of Mn containing dispersed particles.

The number density of Mn containing dispersed particles per unit area and the average diameter of Mn containing dispersed particles ($D_{circle}$) are determined by using high resolution techniques such as TEM or SEM. EDX is associated to chemically identify the Mn containing dispersed particles. Image analysis is preferably implemented to have an automated treatment permitting to directly plot the dispersed distribution (number of Mn containing dispersed particles vs diameter, number of Mn containing dispersed particles vs surface area). SEM observations associated with images analysis provide a good representativeness of the sampling. The results are preferably based on at least 200 images done at high magnification (typical magnification above 20000×, preferentially above 30000×) covering a total analyzed surface of at least 5000 $\mu m^2$. It permits to cover a significant area of the product without the disadvantage of treating high amounts of data.

The number density of Mn containing dispersed particles corresponds to the ratio between the total number of Mn containing dispersed particles, which have been identified by image analysis (for instance by a threshold of grey level set to discriminate aluminum matrix with Mn containing dispersed particles), and the total analysed surface.

The average diameter of Mn containing dispersed particles corresponds to the average $D_{circle}$. It must be understood that by the "diameter" of Mn containing dispersed particles, one wants to say "equivalent diameter", i.e. that of a particle which would be of circular section and would have the same surface as the particle observed, if this one has a section more complex than that of a simple circle. The average $D_{circle}$ corresponds to the equivalent diameter of the circle having the same surface as the average surface of all the Mn containing dispersed particles.

It is also possible with the image analysis to determine the surface fraction area. It corresponds to the ratio between the total surface covered by Mn containing dispersed particles and the total analyzed surface.

Aluminum extruded product as feedstock for forging differ from most extruded by their plain cross-section, i.e. they are solid extrusions, which typically have a simple shape such as a round, rectangle or square. Compared for example to cast feedstock, extruded products are advantageous as feedstock for forging, in particular for relatively small forgings, as they allow the manufacturing of near-net shape parts with higher precision, typically forged products with a total width lower than 50 cm and section with thickness lower than 10 mm. Since the parts in question undergo elevated working rates at critical sections (e.g. aiming at achieving a thinner web thickness), the use of extruded products for forging offers the possibility of reducing the number of deformation passes, therefore restricting the higher strain levels loaded in the thinnest portions of the forged product.

The refined microstructure is further achieved by properly designing the temperature and strain rate schedules both during the extrusion process and forging to favor dynamic recovery over recrystallization.

Moreover, the fibrous microstructure obtained in the feedstock through the extrusion process can be retained during forging, thus ensuring that a fine substructure is achieved in the forged end product, which is beneficial for higher strength as well as fatigue properties.

The inventors found that to ensure a satisfying balance between strength, ductility and fatigue for specific forged products, the maximum fraction of texture components belonging to the <001> fiber is 20%. Surprisingly, the inventors found that by controlling the extrusion ratio below 15, preferably below 13, the <001> fiber texture surface fraction in the extrusion feedstock is limited while <111> fiber texture surface fraction remains higher than 70%. By decreasing the extrusion ratio, recrystallization can be then limited during subsequent deformation. Indeed, limiting <001> fiber texture is supposed to inhibit the formation of potential nuclei for the further development of e.g., Cube recrystallization texture in the end product during subsequent thermomechanical processing steps.

The fraction of texture components belonging to the <001> fiber texture is measured using orientation imaging microscopy (OIM). When the electron beam in a Scanning Electron Microscope (SEM) strikes a crystalline material mounted at an inclined surface (e.g., around 70°), the electrons disperse beneath the surface, subsequently diffracting among the crystallographic planes. The diffracted beam produces a pattern composed of intersecting bands, termed electron backscatter patterns, or EBSPs. EBSPs can be used to determine the orientation of the crystal lattice with respect to some laboratory reference frame in a material of known crystal structure.

"Fraction of <001> fiber components" means the area fraction of texture components belonging to the <001> fiber oriented grains of a given polycrystalline sample as calculated using orientation imaging microscopy using, for example, the EBSD measurements, described in example 2. Within the <001> family, Cube orientation {001}<100>, Goss orientation {011}<100>, rotated Goss {021}<100> as major texture components can be cited.

The forged parts are subjected to dynamic loading conditions over its service life, thus requiring superior fatigue properties, which can only be delivered by a very fine grains structure. A fine substructure is also beneficial for improving corrosion resistance.

By contrast, it has been observed that cast feedstock do not allow the desired refinement of the microstructure.

Example J of EP 2003219 is a good illustration of this statement. Despite a low Fe content (0.02 wt. %), the forged product obtained from the cast feedstock exhibits 100% of recrystallization in the rib structure. EP 2003219 attributed this effect to the too low Fe content, which does not encourage reducing Fe level.

A process for producing the aluminium extruded feedstock for forging according to the invention is described.

Casting a billet of aluminum alloy comprising in weight percent:

Si: 0.6% to 1.4%

Fe: 0.01% to 0.15%, preferably between 0.01% to 0.13%, more preferably between 0.01% to 0.12% and even more preferably between 0.01% to 0.10%.

Cu: 0.05% to 0.60%

Mn: 0.4% to 1%

Mg 0.4% to 1.2%

Cr: 0.05% to 0.25%

Zn≤0.2%

Ti≤0.1%

Zr≤0.05% the rest being aluminium and unavoidable impurities having a content of less than 0.05% each, total being less than 0.15%.

Casting is performed using DC casting or hot top casting.

Said cast billet is homogenized. Homogenizing is done at a temperature ranging from 480° C. to 560° C. during 2 to 12 hours, preferably between 480° C. to 545° C. It can be done in single or multiple steps. Preferably, the homogenizing temperature is in the range of 490° C. to 510° C. during 2 to 12 hours to permit to obtain thin Mn containing dispersed particles, typically Mn containing dispersed particles with an average diameter of less than 50 nm.

Said homogenized billet is extruded as a solid extrusion, with an extrusion ratio less than 15. Preferably the solid extrusion is a round bar shape. Preferably the extrusion ratio is less than 13.

The extrusion ratio is defined by the ratio between the section of the press container and the section of the extrusion.

An extrusion ratio less than 15 permits to increase the number density of Mn containing dispersed particles ensuring a better efficiency to prevent recrystallization during forging or subsequent deformation. Contrary to what was cited in EP2644727, an extrusion ratio lower than 15 permits to retain a fibrous microstructure.

Preferably the composition of step a) comprises in wt. %

Si: 1.2% to 1.3%

Fe: 0.01 to 0.15%, preferably between 0.01% to 0.13%

Cu: 0.05% to 0.15%

Mn: 0.7% to 0.8%, preferably between 0.75% to 0.80%.

Mg: 0.8% to 0.9%, preferably between 0.80% to 0.90%.

Cr: 0.10% to 0.25%

Zn≤0.2%

Ti≤0.1%

Zr≤0.05% the rest being aluminium and unavoidable impurities having a content of less than 0.05% each, total being less than 0.15% The combination of this preferred composition with an homogenization between 490° C. to 510° C. during 2 to 12 hours and an extrusion ratio less than 15, preferably less than 13 permits to obtain an extruded feedstock permitting to obtain on the forged product a good balance between ductility and strength with a yield strength higher than 350 MPa and an elongation higher than 13%.

In another embodiment, the composition of step a) comprises in wt. %

Si: 0.8% to 1 wt. %

Fe: 0.01 to 0.15%, preferably between 0.01% to 0.13%

Cu: 0.40%-0.55%

Mn: 0.4% to 0.6%

Mg: 0.7% to 0.9%, preferably between 0.70% to 0.85%.

Cr: 0.10% to 0.25%

Zn≤0.2%

Ti≤0.1%

Zr≤0.05% the rest being aluminium and unavoidable impurities having a content of less than 0.05% each, total being less than 0.15%.

The process for producing the forged product from the extruded product feedstock can be performed by preforming so that it has a volume distribution resembling the finished product and then, by forging the preformed workpiece in multiple stages. In a preferred embodiment, preforming consists in two pass rolling and bending and forging has intermediate reheating steps at temperature above 500° C.

The forged product is either produced in T5 temper and then artificially aged or produced in T6 or T7 temper with a separate solution heat treatment and artificially aged after final forging steps.

By separate solution heat treatment, it is meant that the final forged product in its final shape is thermally treated in a furnace, and not solution heat treated by the heat induced during forging as can be obtained when the product is produced in a T5 temper.

The recrystallized fraction is measured on the forged product, preferably in the portion where recrystallization is more likely occurring, i.e. in the most deformed area. In an H shape form, the most distorted area is located in the web part where the thickness is the lowest. It is advantageous to reduce recrystallization in this area as it reduces mechanical strength and fatigue properties. This is particularly advantageous when the web thickness of the forged product is less than 8 mm, preferably less than 7 mm and more preferably less than 6 mm.

A forged product obtained from an extrusion feedstock produced according to the invention presents a recrystallization fraction to less than 50%, in the thinnest part of the forged product.

The recrystallization fraction less than 50% is preferably obtained when the cast billet is homogenized at a temperature between 490° C. and 510° C. during 2 to 12 hours.

If the forged product is produced in T5, i.e. not submitted to a separate heat solution treatment, the recrystallization fraction is less than 15% in the thinnest part of the forged product. The recrystallization fraction less than 15% is preferably obtained when the cast billet is homogenized at a temperature between 490° C. and 510° C. during 2 to 12 hours.

EXAMPLES

Example 1

Two billets of diameter 368 mm have been cast with a composition corresponding to alloy C according the invention (see Table 1).

TABLE 1

| | | composition in weight % | | | | | | | | | |
|---|---|---|---|---|---|---|---|---|---|---|---|
| | | Si | Fe | Cu | Mn | Mg | Cr | Zn | Ti | V | Zr |
| C | Inv. | 1.3 | 0.12 | 0.07 | 0.8 | 0.9 | 0.16 | ≤0.05 | ≤0.05 | ≤0.05 | ≤0.05 |

The as-cast billets were subsequently homogenized at a temperature of 500° C. for 4 h.

The homogenized logs were heated to 515° C. and extruded using either a 3-hollow die (extrusion ratio 21.7) to form bars with a diameter of 45 mm, or a 5-hollow die to form bars with a diameter of 45 mm (extrusion ratio of 13.4). The extruded bars exiting from the extrusion press were water quenched.

The bars, delivered in the as-quenched condition, were then submitted to 2 steps of rolling and subsequently to standard forging operation in several forging steps and intermediate heat treatments (typically at temperatures above 500° C.) to produce a H shape whose thickness in the thinner area (web) was 5.4 mm with a total width of 39 mm. Said H shape is dissymmetric and presents a height of 16.4 mm on one side and a height of 9.4 mm on the other side. The forged parts produced in T5 temper were submitted to artificial ageing at 170° C. for 8 h. The forged parts were tensile tested—the results are in Table 2.

TABLE 2

| Mechanical Properties | | | | | |
|---|---|---|---|---|---|
| | Homogenization | Extrusion | Mechanical Properties | | |
| Alloy | treatment | ratio | Rm (MPa) | Rp0.2 (MPa) | A (%) |
| C | 500° C./4 h | 22 | 372 | 346 | 11.7 |
| | | 13 | 375 | 353 | 14.4 |

Example 2

In this example, three alloys E, F, G were cast into billets of diameter 360 mm. The composition of these alloys is listed in Table 3. The logs were homogenized at a temperature (MT) of 500° C. for 5 h. The logs were heated to 515° C. and extruded on indirect extrusion press to form bars and different diameters by varying die diameter and number of hollows, therefore producing the different extrusion ratios as given in Table 3.

The extruded bars exited from the extrusion press at extrusion speeds between 6-8 m/min and were water quenched.

TABLE 3

| | composition in weight % | | | | | | | | |
|---|---|---|---|---|---|---|---|---|---|
| Id. | Si | Fe | Cu | Mn | Mg | Cr | Ti | Zr | Extrusion ratio |
| E | 1.2 | 0.11 | 0.07 | 0.7 | 0.8 | 0.18 | 0.03 | 0.04 | 13 |
| F | 1.2 | 0.12 | 0.07 | 0.8 | 0.8 | 0.18 | 0.03 | 0.04 | 18.3 |
| G | 1.2 | 0.13 | 0.08 | 0.8 | 0.9 | 0.19 | 0.03 | 0.04 | 21.8 |

The microstructure of the extruded alloys was analyzed using OIM to determine the fractions of main texture components, whereas the Mn containing dispersed particles distribution was characterized using SEM and image analysis techniques.

SEM experiment were conducted using a number of fields of 294 images with a field size of 5×3.5 μm, which covered a total analyzed surface of 5145 $\mu m^2$.

The number density of Mn containing dispersed particles corresponds to the ratio between the total number of Mn containing dispersed particles, which has been identified by the image analysis (by a threshold of grey level set to discriminate aluminum matrix with Mn containing dispersed particles), and the total surface covered by Mn containing dispersed particles.

The average diameter of Mn containing dispersed particles corresponds to the average Dcircle. The average $D_{circle}$ corresponds to the equivalent diameter of the circle having the same surface as the average surface over all the Mn containing dispersed particles.

EBSD measurements were performed at the center of the bar in the L-R plane (L direction corresponding to the extrusion direction and R direction being a radius of the bar). Samples were mechanically polished to 1 μm, followed by OPS finishing polishing and an electropolishing with the following conditions (10V 11 s, Kingston solution). The corresponding results of the number density and average diameter or average $D_{circle}$ of Mn containing particles are given in Table 4.

EBSD measurements were conducted on a ULTRA55 SEM, HT=20 kV, tilt=70°, Working distance=12 mm. The area of investigation was about 2.5 mm (L)×1.6 mm (R), with a stepsize of 1.5 μm. The acquisition was done at ×100 magnification. The data were then analysed using EDAX OIM v7.3.0 software. The grain boundary map assumes a misorientation angle of 15°. The fraction of the <001> texture components were determined within 15° deviation around the ideal texture components.

The EBSD maps were submitted to a clean-up procedure using the Neighbor Orientation Correlation by performing several iterations until the fraction of modified grains is less than 1% and subsequently by applying the Grain dilation level 5 until the fraction of modified grains is less than 1%.

Results are presented in Table 5.

TABLE 4

Number of density of Mn containing dispersed particles per $\mu m^2$ and average Dcircle values.

| Id. | | Bar diameter (mm) | Extrusion ratio | Number density (part/$\mu m^2$) | Mn containing Dispersed Particles Average Dcircle (nm) |
|---|---|---|---|---|---|
| E | Inv. | 45 | 13 | 3.1 | 50 |
| F | Ref. | 60 | 18.3 | 2.3 | 60 |
| G | Ref. | 55 | 21.8 | 1.8 | 60 |

Surprisingly, we observed an effect of extrusion ratio on the number density of Mn containing dispersed particles (degree of concentration of countable Mn containing dispersed particles). The lower the extrusion ratio, the higher the number density. This indicates that the materials extruded at low extrusion ratios tend to exhibit a higher concentration of dispersoids per unit area, which reflects on the Zener drag force as it is proportional to the number density, thus accounting for the higher recrystallization resistance of the extruded forging feedstock with lower extrusion ratio during forging operation. Lowering the extrusion ratio has no effect on the fibrous microstructure, as it can be observed in FIG. 5-7.

The Table 5 below presents the percentage fraction of texture components corresponding to orientations of the <001> and <111> fiber textures measured in the center of the billet for each extruded bar.

TABLE 5

Fraction (%) of the texture components of grains with predominant fiber textures <001> and <111>.

| Sample | Extrusion ratio | Position: Center of the bar <001> | <111> |
|---|---|---|---|
| G | 21.8 | 23 | 74 |
| F | 18.3 | 21 | 75 |
| E | 13 | 18 | 73 |

It can be first mentioned that the <111> texture is maintained higher than 70% while varying the extrusion ratio. The fibrous microstructure is also retained when decreasing the extrusion ratio, as it is illustrated in FIG. 5 to FIG. 8 where FIG. 5 corresponds to sample G, FIG. 6 to sample F and FIG. 7 to Sample E.

It is also observed that the lower the extrusion ratio, the lower the fraction of texture components belonging to the <001> fiber. The anti-recrystallization effect due to the Zener drag that prevents recrystallization is further strengthened by limiting the fraction of <001> fiber texture components (e.g. Cube, Goss and rotated Cube) in the feedstock in a content less than 20% by controlling the extrusion ration to less than 15, preferably less than 13. Controlling the fraction of <001> fiber at a maximum of 20% permits to limit the number of potential nuclei for the development of recrystallization textures in the final forged product.

The invention claimed is:

1. An aluminum extruded product as feedstock for forging obtained by a process comprising:

a) casting a billet of aluminum alloy comprising in weight percent:
Si: 0.6% to 1.4%,
Fe: 0.01% to 0.15%,
Cu: 0.05% to 0.15%,
Mn: 0.4% to 1%,
Mg 0.4% to 1.2%,
Cr: 0.05% to 0.25%,
Zn≤0.2%,
Ti≤0.1%,
Zr≤0.05%,
the rest being aluminum and unavoidable impurities having a content of less than 0.05% each, total being less than 0.15%, b) homogenizing said billet at a temperature between 480 to 560° C. for 2 to 12 hours, c) extruding said homogenized billet as a solid extrusion, with an extrusion ratio less than 15, and d) quenching the solid extrusion, wherein the number density of Mn containing dispersed particles is at least equal to 2.5 particles per $\mu m^2$.

2. The aluminum extruded product as feedstock for forging according to claim 1 wherein the average diameter of Mn containing dispersed particles is less than 80 nm.

3. The aluminum extruded product as feedstock for forging according to claim 1 wherein the maximum fraction of texture components belonging to the <001>fiber is 20%.

4. The aluminum extruded product as feedstock for forging according to claim 1 wherein Fe content is between 0.01 wt. % to 0.13 wt. %.

5. The aluminum extruded product as feedstock for forging according to claim 1 comprising in weight percent:
Si: 1.2% to 1.3%
Cu: 0.05% to 0.15%
Mn: 0.7% to 0.8%
Mg: 0.8% to 0.9%
Cr: 0.10% to 0.25%.

6. The aluminum extruded product as feedstock for forging according to claim 1 comprising in weight percent:
Si: 0.8% to 1%
Cu: 0.05% to 0.15%
Mn: 0.4% to 0.6%
Mg: 0.7% to 0.9%
Cr: 0.10% to 0.25%.

7. The aluminum extruded product according to claim 1, wherein the number density of Mn containing dispersed particles is at least equal to 3.0 particles per $\mu m^2$.

8. The aluminum extruded product as feedstock for forging according to claim 1 wherein the average diameter of Mn containing dispersed particles is less than 60 nm.

9. The aluminum extruded product as feedstock for forging according to claim 1, wherein the average diameter of Mn containing dispersed particles is 50 nm or less.

10. A process for manufacturing aluminum extrusion feedstock for forging comprising:

a) casting a billet of aluminum alloy comprising in weight percent:
Si: 0.6% to 1.4%
Fe: 0.01% to 0.15%
Cu: 0.05% to 0.60%
Mn: 0.4% to 1%
Mg 0.4% to 1.2%
Cr: 0.05%-0.25%
Zn≤0.2%
Ti≤0.1%
Zr≤0.05%
the rest being aluminum and unavoidable impurities having a content of less than 0.05% each, total being less than 0.15% b) homogenizing said billet at a temperature between 480 to 560° C. for 2 to 12 hours c) extruding said homogenized billet as a solid extrusion, with an extrusion ratio less than 15, optionally as a round bar shape, and d) quenching the solid extrusion.

11. The process for manufacturing aluminum extrusion feedstock for forging according to claim 10 wherein the Fe content of the composition of the aluminum alloy billet casted at a) is between 0.01 wt. % to 0.13 wt. %.

12. The process for manufacturing aluminum extrusion feedstock for forging according to claim 10 wherein the composition of the aluminum alloy billet casted at step a) comprises in weight %:
Si: 1.2% to 1.3%
Fe: 0.01% to 0.15%
Cu: 0.05% to 0.15%
Mn: 0.7% to 0.8%
Mg: 0.8% to 0.9%
Cr: 0.10% to 0.25%
Zn≤0.2%
Ti≤0.1%
Zr≤0.05%
the rest being aluminum and unavoidable impurities having a content of less than 0.05% each, total being less than 0.15%.

13. The process for manufacturing aluminum extrusion feedstock for forging according to claim 10 wherein the composition of the aluminum alloy billet cast at a) comprises in weight %:
Si: 0.8% to 1 wt. %
Fe: 0.01% to 0.15%
Cu: 0.40% — 0.55%
Mn: 0.4% to 0.6%
Mg: 0.7% to 0.9%
Cr: 0.10% to 0.25%
Zn≤0.2%
Ti≤0.1%
Zr≤0.05%
the rest being aluminum and unavoidable impurities having a content of less than 0.05% each, total being less than 0.15%.

14. The process for manufacturing aluminum extrusion feedstock for forging according to claim 10 wherein homogenizing of said billet is performed at a temperature between 490° C. to 510° C. for 2 to 12 hours.

15. The process for manufacturing an aluminum forged product according to claim 10, wherein after d) forging is performed.

16. The process for manufacturing an aluminum forged product according to claim 15 wherein the homogenizing of b) is performed at a temperature between 490 to 510° C.

17. An aluminum forged product obtained by the process of claim 16, wherein the forged product presents at a thinnest location a recrystallized fraction equal to or less than 50%.

18. An aluminum forged product comprising in weight percent:
Si: 1.2% to 1.3%
Fe: 0.01% to 0.15%
Cu: 0.05% to 0.15%
Mn: 0.7% to 0.8%
Mg: 0.8% to 0.9%
Cr: 0.10% to 0.25%
Zn≤0.2%
Ti≤0.1%
Zr≤0.05%
the rest being aluminum and unavoidable impurities having a content of less than 0.05% each, total being less than 0.15%,
obtained by the process of claim 16, wherein the forged product presents at a thinnest location an improved balance between ductility and strength with a yield strength higher than 350 MPa and an elongation higher than 13%.

19. The aluminum extruded product as feedstock for forging according to claim 1, wherein the extrusion ratio is less than 16.

* * * * *